US010100423B2

(12) United States Patent
Hall et al.

(10) Patent No.: US 10,100,423 B2
(45) Date of Patent: Oct. 16, 2018

(54) ELECTRODEPOSITION OF CHROMIUM FROM TRIVALENT CHROMIUM USING MODULATED ELECTRIC FIELDS

(71) Applicants: Timothy D. Hall, Englewood, OH (US); Burhanuddin Kagajwala, Hillsboro, OR (US)

(72) Inventors: Timothy D. Hall, Englewood, OH (US); Burhanuddin Kagajwala, Hillsboro, OR (US)

(73) Assignee: FARADAY TECHNOLOGY, INC., Englewood, OH (US)

( * ) Notice: Subject to any disclaimer, the term of this patent is extended or adjusted under 35 U.S.C. 154(b) by 469 days.

(21) Appl. No.: 14/826,971

(22) Filed: Aug. 14, 2015

(65) Prior Publication Data

US 2015/0354077 A1 Dec. 10, 2015

Related U.S. Application Data

(62) Division of application No. 13/768,285, filed on Feb. 15, 2013.

(60) Provisional application No. 61/603,646, filed on Feb. 27, 2012.

(51) Int. Cl.

| | |
|---|---|
| ***C25D 3/06*** | (2006.01) |
| ***C25D 5/18*** | (2006.01) |
| ***C25D 3/10*** | (2006.01) |

(52) U.S. Cl.

CPC ..... *C25D 5/18* (2013.01); *C25D 3/06* (2013.01); *C25D 3/10* (2013.01)

(58) Field of Classification Search

CPC ... C25D 5/18; C25D 3/06; C25D 3/04; C25D 3/10

See application file for complete search history.

(56) References Cited

U.S. PATENT DOCUMENTS

| | | | | |
|---|---|---|---|---|
| 2,980,593 A | | 4/1961 | Larson | |
| 3,183,176 A | | 5/1965 | Schwartz | |
| 4,157,945 A | * | 6/1979 | Ward | C25D 3/06 205/286 |
| 4,167,460 A | * | 9/1979 | Tomaszewski | C25D 3/06 205/243 |

(Continued)

FOREIGN PATENT DOCUMENTS

| | | | | |
|---|---|---|---|---|
| CN | 101781781 A | * | 7/2010 | |
| GB | 1488381 | * | 10/1977 | |
| JP | S61-92371 A | * | 5/1986 | F16K 1/32 |

OTHER PUBLICATIONS

Li & Liu translation, CN 101781781 A (2010) (Year: 2010).*

(Continued)

*Primary Examiner* — Bryan D. Ripa
*Assistant Examiner* — Ho-Sung Chung
(74) *Attorney, Agent, or Firm* — Thompson Hine LLP

(57) ABSTRACT

A layer of chromium metal is electroplated from trivalent chromium onto an electrically conducting substrate by immersing the substrate and a counter electrode in a electroplating bath and passing a modulated electric current between the electrodes. In one embodiment, the current contains pulses that are cathodic with respect to said substrate and in another embodiment the current contains pulses that are cathodic and pulses that are anodic with respect to said substrate. The cathodic pulses have a duty cycle greater than about 80%.

14 Claims, 3 Drawing Sheets

(56) References Cited

U.S. PATENT DOCUMENTS

| | | | | |
|---|---|---|---|---|
| 4,432,843 | A * | 2/1984 | Tremmel | C25D 3/06 204/DIG. 13 |
| 4,585,530 | A | 4/1986 | McMullen et al. | |
| 4,610,763 | A * | 9/1986 | Law | C25D 3/56 205/184 |
| 4,804,446 | A * | 2/1989 | Lashmore | C25D 3/06 106/1.05 |
| 5,196,109 | A * | 3/1993 | Scott | C25D 3/06 205/287 |
| 6,203,684 | B1 | 3/2001 | Taylor et al. | |
| 6,402,931 | B1 | 6/2002 | Zhou et al. | |
| 6,652,727 | B2 | 11/2003 | Taylor et al. | |
| 7,553,401 | B2 | 6/2009 | Gebhart et al. | |
| 7,947,161 | B2 | 5/2011 | Gebhart et al. | |
| 2006/0012044 | A1* | 1/2006 | Knop | C25D 5/18 257/750 |
| 2007/0227895 | A1 | 10/2007 | Bishop et al. | |
| 2008/0041728 | A1* | 2/2008 | Chalmer | C25D 3/06 205/283 |
| 2008/0274373 | A1 | 11/2008 | Takahashi | |
| 2008/0302668 | A1* | 12/2008 | Konigshofen | C25D 3/02 205/262 |
| 2009/0211914 | A1* | 8/2009 | Huang | C25D 3/06 205/289 |
| 2010/0122909 | A1 | 5/2010 | Murakami et al. | |
| 2010/0243463 | A1* | 9/2010 | Herdman | C25D 3/06 205/180 |
| 2011/0017608 | A1 | 1/2011 | Taylor et al. | |

OTHER PUBLICATIONS

Lou & Huang, Electroplating, Encyclopedia of Chem. Proc. (2006) (Year: 2006).*

Bard et al., Electrochemical Dictionary 9 (2008) (Year: 2008).*

Sawyer, Metal-Gluconate Complexes, 64(6) Chem. Reviews 633 (1964) (Year: 1964).*

Kamio et al., machine translation, JP S61-092371 (1986).*

Renz et al., "Effects of Bath Chemistry, Solution Hydrodynamics, and Electrical Mediation on Trivalent Chromium Plating," Proc. AESF Surf/Fin (2001).

Hong et al. "Derwent Abstract", S. G. 53086 A1 (2010).

Ember, L.R., "Rising Pollution Control Costs May Alter EPA's Regulatory Direction," Chemical and Engineering News, pp. 25-26 (Feb. 18, 1991).

Mikkola, R.D. et al., "Copper Electroplating for Advanced Interconnect Technology," Plating and Surface Finishing, pp. 81-85 (Mar. 2000).

Podlaha, E.J. et al., "Pulse-Reverse Plating of Nanocomposite Thin Films," J. Electrochem. Soc., vol. 144, No. 7, pp. L200-L202 (Jul. 1997).

Office Action, U.S. Appl. No. 13/768,285 (dated Jan. 14, 2015).

Office Action, U.S. Appl. No. 13/768,285 (dated Jun. 15, 2015).

* cited by examiner

ELECTRODEPOSITION OF CHROMIUM FROM TRIVALENT CHROMIUM USING MODULATED ELECTRIC FIELDS

CROSS REFERENCE TO RELATED APPLICATIONS

This application is a divisional of U.S. patent application Ser. No. 13/768,285, filed Feb. 15, 2013, and which claims priority to U.S. Provisional Patent Application No. 61/603,646 filed Feb. 27, 2012. The entireties of these applications are incorporated by reference herein.

GOVERNMENT RIGHTS

The experimental work leading to this invention was funded in part by EPA Phase I SBIR program. Contract No. EP-D-11-044. The U.S. Government may have certain rights in the invention.

FIELD OF THE INVENTION

This invention relates to electrodeposition of chromium metal and more particularly to electrodeposition of chromium metal from a trivalent chromium electroplating bath as contrasted with conventional carcinogenic hexavalent chromium electroplating bath.

BACKGROUND

The US Environmental Protection Agency identified hexavalent chromium as one of 17 "high-priority" toxic chemicals based on their known health and environmental effects, production volume, and potential for work exposure. Typical thick, hard chrome coatings have been produced from a hexavalent chromium bath using a direct current deposition process. One problem associated with this type of coating process is worker exposure to the hexavalent chromium during plating, which is overcome by replacing the carcinogenic material with a benign trivalent chromium plating electrolyte. Through control of the deposition processing a chrome coating with physical properties comparable to chrome coatings obtained using hexavalent chromium has been produced in a scalable manner using the more benign metal.

SUMMARY OF THE INVENTION

A range of process conditions that allow for the scalable production of dense hard chrome coatings from a trivalent chromium plating bath have been developed. In one embodiment the coatings have a Knoop microhardness values of at least about 804 KHN and up to about 1067 KHN, and about 947 KHN on average. Using a pulsed waveform and a trivalent chromium electroplating bath, the processes produce chrome coatings exhibiting bond strength, porosity, hardness, and wear resistance demonstrating the potential of the developed coatings competitive with conventional chrome coatings produced from a hexavalent chromium bath. Representative processing conditions that improve the visual uniformity and density of the coating are summarized below:

High Forward Duty Cycles: A visually uniform coating was observed for forward duty cycles greater than about 80%. Duty cycles lower than about 80% yielded less uniform coatings. This was observed for low as well has high frequency pulses. In one embodiment uniform coatings are achieved using duty cycles of about 80 to 99%. In another embodiment the duty cycles are about 85 to 95%.

High Frequency Forward Only Pulsing: A pulsing waveform with a forward duty cycle of greater than about 80% and current density in the range of about 25-45 A/dm$^2$ and scalability at frequencies greater than about 100 Hz, was observed to produce a coating with better visual uniformity than at direct current. In one embodiment the high frequency forward only process is performed at 200 to 2000 Hz. In another embodiment it is performed at frequencies of about 500 to 1000 hz Low Frequency Forward and Reverse Pulsing: A pulsing waveform with a forward duty cycle of greater than about 80%, a reverse duty cycle less than about 10% and current density in the range of about 25-45 A/dm$^2$ was observed to produce a coating with better visual uniformity and scalability at frequencies lower than about 500 Hz, than at direct current. In one embodiment the low frequency forward and reverse pulsing process is performed at frequencies of about 1 to 500 Hz. In another embodiment it is performed at frequencies of about 10 to 200 Hz.

Each of the foregoing processing parameters has been shown to enhance the visual uniformity of the coating across shafts of various diameters.

The present invention provides a process for producing dense, scalable hard chrome coatings from a trivalent chromium plating bath. The process involves controlling the electric field during electrodeposition to plate the substrates, e.g., a steel landing gear, with a chrome coating that is as hard and wear resistant.

The electrodeposition process proceeds by first submerging the substrate upon which the chrome coating is to be deposited into an electrolyte bath while applying a cathodic bias to the substrate by connecting the substrate electrically to the negative terminal of a power supply capable of supplying pulse and pulse reverse electric fields at controlled overpotentials. The electrolyte bath includes trivalent chromium metal ions that reduce on the cathodically biased substrate to form the metallic chrome deposit. The supporting electrolyte will be used to provide conductivity, buffer control, and counter ions, and may or may not contain chelating or surfactant chemistries, e,g., chelating agents like citric acid, to reduce or increase the deposition overpotential, and ionic surfactants like Triton X-100, to increase coating uniformity via enhanced surface wetting. A counter electrode that may be an insoluble material such as but not limited to platinum and titanium, is also submerged into the electrolyte bath and an anodic bias is applied to the counter electrode by connecting the counter electrode to the positive terminal of the power supply.

To improve the coating uniformity to long length scales, the electric field applied between the substrate and the counter electrode may be interrupted or the magnitude maybe varied during the electrodeposition process such that the electric field is turned on and off many times or intensity is varied across the substrates surface. Additionally, the polarity of the substrate upon which the chrome coating is to be formed may be reversed during the pulsing of the electric field during the electrodeposition process such that the deposition substrate becomes anodic for a period of time and the counter electrode becomes cathodic for a period of time. A schematic illustration of a pulse reverse waveform used in one embodiment is provided in FIG. 1, which consists of a cathodic pulse current density, $i_c$, a cathodic on-time $t_c$, an anodic pulse current density $i_a$, an anodic on-time, $t_a$, and an off-time $t_o$. The reverse portion of the waveform in FIG. 1 may not be included, such that a pulse waveform that only consists of the cathodic pulse current density, $i_c$, a cathodic on-time $t_c$, and an off-time, $t_o$ is used for electrodeposition and said FIG. 1 is not limited by such. The sum of the cathodic and anodic on-times and the off-time is the period, T, of the pulse reverse waveform and the inverse of the period is the frequency, f. The cathodic $\gamma_c$ and anodic $\gamma_a$, duty cycles are the ratios of the respective on-times to the period. The average current density or net electrodeposition rate cathodic (forward) is given by:

$$\text{Electrodeposition rate}=i_c\gamma_c-i_a\gamma_a$$

During the forward cathodic pulse, the metal is deposited onto the surface of the substrate. During the reverse anodic pulse, part of the plated metal is dissolved back into solution, resulting in enrichment of the ion concentration at the surface of the deposit. This enhanced control allows the desired coatings properties to be more easily achieved compared to using direct current electrodeposition, in which the current is maintained at a constant value for the duration of the process. Cross-sectional analysis data of chromium deposition on 4130 steel pipes with various lengths and diameters has been performed. The data demonstrated a range of processing conditions that produced a thick dense chrome coating could be formed along the length of at least an 8" shaft. The specific conditions included the use of forward only waveforms with frequency at or greater than 500 Hz, more particularly, about 500 to 1000 Hz and at least a forward duty cycle of about 85% to 95% in one embodiment; and waveforms with forward and reverse times and a frequency less than 500 Hz and more particularly about 10 to 200 Hz and forward duty cycles greater than about 80% and more particularly about 85 to 95%.

In one embodiment, chromium coatings are electrodeposited from a trivalent chromium plating bath by pulse plating at duty cycles greater than about 80% and more particularly about 85 to 95%, frequencies greater than about 100 Hz and more particularly 200 to 2000 Hz, and current densities in the range of about 25-45 A/dm$^2$. In another embodiment, they are deposited by pulse reverse plating with forward duty cycles greater than about 80% and more particularly 85 to 95%, reverse duty cycles less than about 10%, frequencies less than 500 Hz, more particularly about 10 to 200 Hz, and current densities in the range of about 25-45 A/dm$^2$. Generally, duty cycles greater than about 80%, more particularly about 85 to 95%, are required to plate chromium from a trivalent plating bath.

To further enhance coating property control anode shields can be installed in situ in order to better control the local current density of the cathode. Additionally, an electrochemical cell that facilitates uniform flow and thus uniform hydrodynamic conditions across the surface of a substrate and would facilitate the mass transport of chromium ions to the substrate surface was used. Such a cell is disclosed in U.S. Pat. Nos. 7,553,401 and 7,947,161.

In summary, in one embodiment the selective deposition is accomplished by a process in which an electrically conductive substrate is immersed in an electroplating bath containing ions of trivalent chromium, and provided with a suitable counterelectrode, and a modulated reversing electric current is passed through the plating bath having pulses that are cathodic with respect to the substrate and pulses that are anodic with respect to the substrate, the cathodic pulses having a long duty cycle and the anodic pulses having a short duty cycle, the charge transfer ratio of the cathodic pulses to the anodic pulses being greater than one or effectively greater than one when the current efficiencies of the cathodic and anodic processes are taken into account, and the frequency of the pulses ranging from about 1 Hertz to about 5000 Hertz.

The plating bath used in one embodiment of the invention may be chromium sulfate in the form of Chrometan Powder (Elementis Chromium) (163.33 gr/L), ammonium sulfate [$(NH_4)_2SO_4$] (100 gr/L) for enhanced conductivity, boric acid [$HBO_3$] (21 gr/L) as a buffer, formic acid [HCOOH] (60 mL/L) as a chelating agent, sodium n-dodecyl sulfate [$CH_3(CH_2)_{11}OSO_3Na$] (0.4 gr/L) as a surfactant, chromium(II) chloride [$CrCl_2$] (0.234 gr/L), and potassium hydroxide [KOH] (~26 gr/L) for pH adjustment to 2.5.

DETAILED DESCRIPTION

Figure 1:
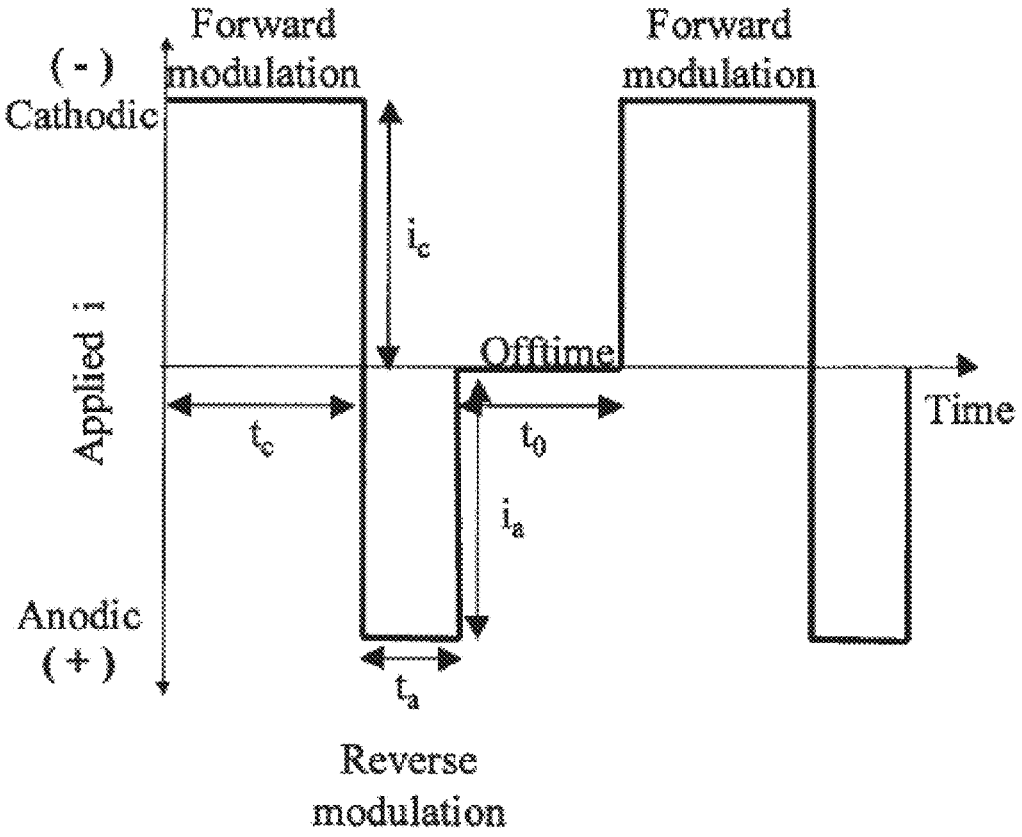
FIG. 1 is a schematic illustration of a pulse reverse waveform used in one embodiment.

The present invention relates to an electrodeposition process for producing dense scalable hard chrome coatings from an environmentally benign trivalent chromium electrolyte. The invention takes advantage of electric field control to enhance the chrome coating uniformity and density. The electrodeposition process occurs by submerging the deposition substrate into an electrolyte bath containing the chromium metal ions to be reduced, and supporting electrolyte chemistries. While submerged in the electrolyte bath, an electric field is applied between the substrate, which functions as the cathode and upon which the chrome coating is to be deposited, and a counter electrode that functions as the anode. Moreover, this electric field may be manipulated, via shielding, overpotential variation, and/or pulsed during the electrodeposition process such that the electric field is controlled in such a way that the coatings density and uniformity is improved. Additionally, to improve the coatings microstructural properties produced during the process, the polarity of the substrate upon which the controlled chrome coating is to be formed may be reversed during the pulsing of the electric field such that the deposition substrate becomes anodic for period of time and the counter electrode becomes cathodic for the same period of time.

Representative examples of substrates that can be coated with chrome in accordance with the invention including but not limited to iron and its alloys, including engineering steels, carbon steels, stainless steels, and aircraft steels, aluminum and its alloys, copper and its alloys, molybdenum and its alloys, and nickel and its alloys.

In electroplating, it is conventional to add certain chemicals to the plating bath to achieve certain characteristics of the deposit. These materials are included in the plating bath for specific purposes, and the terminology used to identify them generally describes the effect that they produce. The purpose of these materials and their nomenclature is summarized in Mikkola et al., *Plating and Surface Finishing*, March 2000, pages 81-85, the entire disclosure of which is incorporated herein by reference.

In many metal plating baths small amounts of organic compounds are added, typically in concentrations of a few parts per million, in order to achieve a bright, shiny surface on the deposited metal. Such compounds, generally referred to as brighteners, tend to produce an even, fine-grained deposit, and are thought to operate by their effect on the nucleation of the metal grains. These compounds typically contain sulfur and other functional groups, and include such compounds as thiourea, and derivatives thereof, mercaptopropane sulfonic acid and the like.

A second class of additive compounds, also present in small amounts (typically a few parts per million), are those that produce a level deposit ("levelers"), i.e., a smooth deposit that fills in microscopic irregularities in the plating substrate. They are believed to operate by selective adsorption to readily accessible surfaces such as protruding high points or flat surfaces, whereby they decrease the rate of electrodeposition at those locations. Such compounds include polyamines, derivatives of safronic dyes, and the like.

Both the brighteners and levelers are consumed in the course of electroplating. Consequently, their concentration must me monitored and controlled by periodic additions. Because the concentrations are low and the amounts to be added are small, the control of the brightener and leveler concentrations presents some problems for the electroplater.

Another type of compound that is included in the bath for certain metals is generally known as a carrier or suppressor. Such compounds are typically used with metals that are plated efficiently, such as copper and zinc. These are believed to have a beneficial effect on the grain size of the deposit because they are adsorbed to the surface and decrease the rate of deposition. Such compounds are typically present in a concentration substantially greater than that of the brighteners and levelers, typically 100 parts per million or greater. Accordingly, it is significantly easier to control the concentration of a carrier compound than of a leveler or brightener. Suppressors or carriers include polyhydroxy compounds such as polyglycols, e.g., poly(ethylene glycol), polypropylene glycol), and copolymers thereof.

The electroplating bath used in one embodiment of the process of the invention can be any conventional electroplating bath appropriate for chromium plating. For electroplating chromium onto a surface, one bath is an aqueous trivalent chromium bath incorporating about 163 g/l of chromium sulfate in the form of Chrometan Powder (Elementis Chromium), 100 g/l ammonium sulfate, 21 g/l boric acid, 60 ml/l formic acid, 0.4 g/l sodium n-dodecyl sulfate, 0.23 g/l chromium (II) chloride, and 26 g/l potassium hydroxide. A pulse train frequency of about 1000 Hz with a cathodic duty cycle of at least about 80%, an anodic duty cycle of about 10% and a cathodic/anodic charge transfer ratio of about 97:3 or less appeared to give superior results.

In another embodiment, a plating bath comprised an aqueous solution containing 163 g/l of chromium sulfate in the form of Chrometan Powder (Elementis Chromium), 100 g/l ammonium sulfate, 21 g/l boric acid, 60 ml/l formic acid, 0.4 g/l sodium n-dodecyl sulfate, 0.23 g/l chromium (II) chloride, 26 g/l potassium hydroxide.

Other plating baths used in other implementations of the invention may contain:

| Compound | Approximate Range | Approximate Typical Range (when present) |
|---|---|---|
| Sodium Gluconate | 0 to 0.5 mol/l | 0.05 to 0.2 mol/l |
| Triton X 100 | 0 to 1000 ppm | 100 to 500 ppm |
| Citric Acid | 0 to 0.5 mol/l | 0.5 to 0.2 mol/l |

-continued

| Compound | Approximate Range | Approximate Typical Range (when present) |
|---|---|---|
| 400 Mw Polyethylene Glycol | 0 to 1000 ppm | 100 to 500 ppm |
| Ethylenediaminetetraacetic acid | 0 to 1000 ppm | 100 to 500 ppm |
| 8000 Mw Polyethylene Glycol | 0 to 1000 ppm | 100 to 500 ppm |
| Chrometan Powder (75% w/w chromium sulfate) | 100 to 300 g/l | 140 to 180 g/l |
| Ammonium Sulfate | 25 to 500 g/l | 50 to 200 g/l |
| Boric Acid | 5 to 40 g/l | 15 to 30 g/l |
| Sodium n-dodecyl sulfate | 0.01 to 1.0 g/l | 0.2 to 0.6 g/l |
| Chromium (II) chloride | 0 to 1.0 g/l or 0.01 to 1.0 g/l | 0.15 to 0.5 g/l |
| Potassium Hydroxide | 15 to 50 g/l | 20 to 32 g/l |

A schematic representation of a rectangular modulated reverse electric field waveform used in the process of the invention is illustrated in FIG. 1. The waveform essentially comprises a cathodic (forward) pulse followed by an anodic (reverse) pulse. An off-period or relaxation period may follow either or both of the cathodic and anodic pulses. Those skilled in the art will recognize that the voltage and current will be proportional under the circumstances of the electrolytic process of the invention. Accordingly, the ordinate in FIG. 1 could represent either current or voltage. Although it is generally more convenient in practice to control the voltage, the technical disclosure of the process is more straightforward if discussed in terms of the current flow. Furthermore, the waveform need not be rectangular as illustrated. The cathodic and anodic pulses may have any voltage-time (or current-time) profile. In the following discussion rectangular pulses are assumed for simplicity. Again, one skilled in the art will recognize that the point in time chosen as the initial point of the pulse train is entirely arbitrary. Either the cathodic pulse or the anodic pulse (or any point in the pulse train) could be considered as the initial point. The representation with the cathodic initial pulse is introduced for simplicity in discussion.

In FIG. 1, the cathodic peak current is shown as $i_c$ and the cathodic on-time is $t_c$. Similarly, the anodic peak current is shown as $i_a$ and the anodic on-time is $t_a$. The relaxation time, or off-times are indicated by $t_o$. The sum of the cathodic on-time, anodic on-time, and off-times (if present) is the period T of the pulse train ($T=t_c+t_a+t_o$), and the inverse of the period of the pulse train (1/T) is the frequency (f) of the pulse train. The ratio of the cathodic on-time to the period ($t_c/T$) is the cathodic duty cycle, and the ratio of the anodic on-time to the period ($t_a/T$) is the anodic duty cycle. The current density, i.e., current per unit area of the electrode, during the cathodic on-time and anodic on-time is known as the cathodic peak pulse current density and anodic peak pulse current density, respectively. The cathodic charge transfer density is the product of the cathodic current density and the cathodic on-time, while the anodic charge transfer density is the product of the anodic current density and the anodic on-time. The average current density is the average cathodic current density minus the average anodic current density.

According to one embodiment of the invention the cathodic duty cycle should be $t_c+t_a+t_o$ at least about 80%, and the cathodic pulses should be relatively long greater than about 85% to favor uniform deposition of metal. Conversely, the anodic duty cycle should be relatively short, less than about 10%, and the anodic pulses should be relatively long in order to favor removal of excess metal from the convex and peak portions of the substrate surface. Because the anodic duty cycle is shorter than the cathodic duty cycle, the peak anodic voltage (and corresponding current) will be less than the peak cathodic voltage (and corresponding current). Accordingly, the cathodic-to-anodic net charge ratio will be greater than one, in order to provide a net deposition of metal on the surface.

In another embodiment, the frequency of the pulse train used in the method of the invention may range from about 100 Hertz to about 500 Hertz. An anodic pulse is introduced between at least some of the cathodic pulses. However, it is not excluded that two or more cathodic pulses may be introduced between a pair of anodic pulses. In particular, a plurality of very short (e.g., 0.1 msec) anodic pulses may be followed by one relatively long cathodic pulse (e.g., 1.0 msec). Accordingly, a number of cathodic and anodic pulses with defined pulse widths may make up one group of pulses, which is then repeated. Typically such a group would include one or more cathodic pulses and at least one anodic pulse. The first pulse of the modulated reversing electric field is typically applied to make the element to be plated the cathode, i.e., it is a cathodic pulse with respect to the element to be plated. The cathodic pulse causes a thin layer of metal to be plated onto the surface of the element. The duration of the cathodic pulse is adjusted so that the metal is deposited relatively uniformly over the surface of the element. However, because the pulse is of finite duration, a diffusion layer of some small thickness will develop, which may cause some non-uniformity in the layer of metal deposited. Accordingly, some excess metal may be deposited. Some of the metal plated during the cathodic pulse is removed during the anodic pulse. Accordingly, the excess metal that may have been deposited during the cathodic pulse tends to be removed by the anodic pulse.

The pulse width, duty cycle, and applied voltage of the cathodic and anodic pulses must be adjusted to provide that the overall process is cathodic, i.e., there is a net deposition of metal on the substrate workpiece. Consequently, the charge ratio will generally be greater than 1. However, because the relative current efficiencies of the plating and depleting portions of the cathodic-anodic pulse cycle, it is possible in some cases to observe net deposition of metal with a applied charge ratio somewhat less than one, e.g, as low as 0.90 or even less. The practitioner will adapt the pulse width, duty cycle, and frequency to a particular application, based on the principles and teachings of the process of the invention.

The method of the invention may be used with chromium alone or any or metal that can be deposited and/or alloyed with chromium by electroplating techniques. Thus copper, silver, gold, zinc, nickel, and alloys thereof such as bronze, brass, and the like, may be applied in combination with chromium by the process of the invention.

The thickness of the chromium layer is application dependent and typically is about 5 to 500 microns depending on the application of interest.

The electrodeposition was conducted using a number of different electric field conditions of the prior art as well as the modulated reversed electric field of the invention.

EXAMPLES

The present invention will be illustrated by the following examples, which are intended to be illustrative and not limiting.

A visually uniform and scalable coating can be formed the inner diameter of 4130 steel pipes, used din the landing gear of aircrafts. A dimensionally stable anode (DSA) was used as the counter electrode. The electrodeposition process parameters used to deposit a visually uniform coating consisted forward only pulse waveform with a forward duty cycle of at least 80% and a frequency of at least 500 Hz at the applied forward current density between 25 and 45 A/dm$^2$. The nominal electrolyte bath temperature was between 90 and 150° F. and electrolyte flow rate held constant throughout the deposition process.

Figure 2:
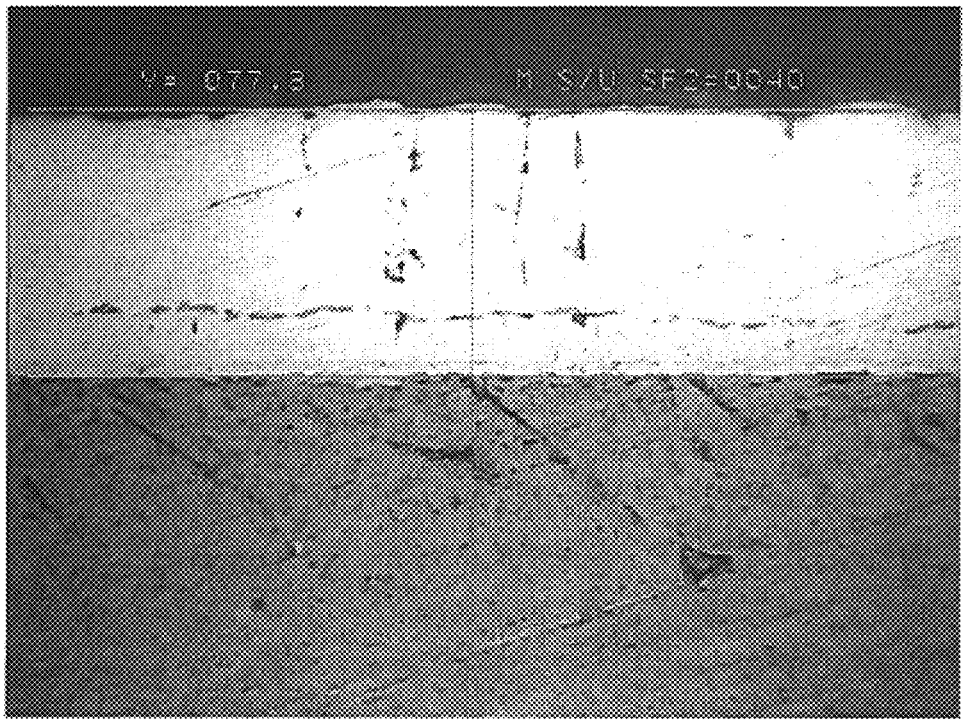
FIG. 2 shows the microstructure of the chrome coating developed on the inner diameter of a 4130 steel pipe with a thickness of 77 μm.
Figure 3:
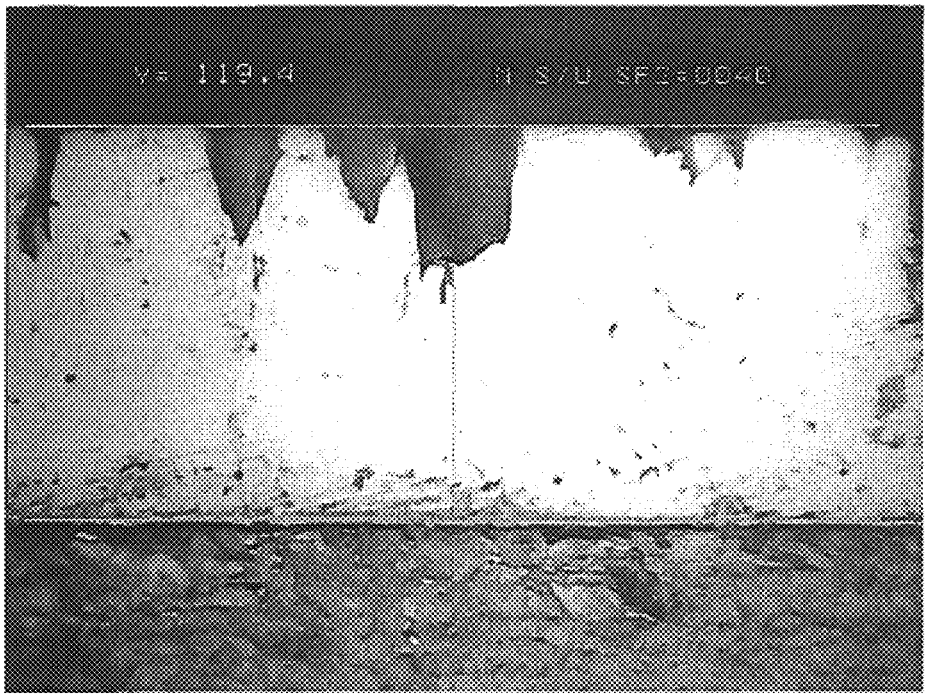
FIG. 3 shows the microstructure of the chrome coating developed on the inner diameter of a 4130 steel pipe with a thickness of 119 μm.

FIG. 2 and FIG. 3 demonstrate the microstructure of the coatings obtained during deposition the process. These cross-sections show a dense coating with few microcracks, which are advantageous for the production of a wear resistant chrome coating. These cross-sections were taken from various sections of the evaluated pipe.

A visually uniform and scalable coating can be formed the inner diameter of 4130 steel pipes, used din the landing gear of aircrafts. A dimensionally stable anode (DSA) was used as the counter electrode. The electrodeposition process parameters used to deposit a visually uniform coating consisted of a bipolar pulse waveform with a forward duty cycle of at least about 90%, a reverse duty cycle less than or equal to about 3%, and a frequency less than or equal to about 100 Hz at the applied forward and reverse current density between about 25 and 45 A/dm$^2$. The nominal electrolyte bath temperature was between 90 and 150° F. and electrolyte flow rate was held constant throughout the deposition process.

The embodiments in the Example have been demonstrated using varying 4130 pipe length (about 2 to 12 inches) and varying pipe diameter (about 1 to 3½ inches) without additional preparation, cell modification, or processing challenges.

The invention having now been fully described, it should be understood that it might be embodied in other forms or variations without departing from its spirit or essential characteristics. Accordingly, the embodiments described above are to be considered in all respects a illustrative and not restrictive, the scope of the invention being indicated by the claims rather than the foregoing description, and all changes which come within the meaning and range of equivalency of the claims are intended to be embraced therein.

What is claimed is:

1. A method for depositing a layer of chromium metal onto a substrate comprising:

immersing an electrically conductive substrate in an electroplating bath containing trivalent chromium ions;

immersing a counter electrode in the plating bath; and passing an electric current between the substrate and the counter electrode, and wherein:

the electric current is a modulated current comprising pulses that are cathodic with respect to the substrate, and the electric current lacks pulses that are anodic with respect to the substrate;

the cathodic pulses have a duty cycle greater than about 80%;

the cathodic pulses form a pulse train having a frequency greater than about 500 Hertz; and the bath comprises:

| Compound | Approximate Range |
|---|---|
| Sodium gluconate | 0.05 to 0.2 mol/l |
| Triton X 100 | 100 to 500 ppm |

-continued

| Compound | Approximate Range |
|---|---|
| Citric acid | 0.2 to 0.5 mol/l |
| 400 MW Polyethylene glycol | 100 to 500 ppm |
| Ethylenediaminetetraacetic acid | 100 to 500 ppm |
| 8000 Mw Polyethylene glycol | 100 to 500 ppm |
| Chrometan powder (75% w/w chromium sulfate) | 140 to 180 g/l |
| Ammonium sulfate | 50 to 200 g/l |
| Boric acid | 15 to 30 g/l |
| Sodium n-dodecyl sulfate | 0.2 to 0.6 g/l |
| Chromium (II) chloride | 0.15 to 0.5 g/l |
| Potassium hydroxide | 20 to 32 g/l |

2. A method for depositing a layer of chromium metal onto a substrate comprising:

immersing an electrically conductive substrate in an electroplating bath containing trivalent chromium ions;

immersing a counter electrode in the plating bath; and passing an electric current between the substrate and the counter electrode, wherein the electric current is a modulated current comprising pulses that are cathodic with respect to the substrate, and wherein the electric current lacks pulses that are anodic with respect to the substrate; and wherein the bath comprises:

| Compound | Approximate Range (when present) |
|---|---|
| Sodium gluconate | 0.05 to 0.2 mol/l |
| Triton X 100 | 100 to 500 ppm |
| Citric acid | 0.2 to 0.5 mol/l |
| 400 Mw Polyethylene glycol | 100 to 500 ppm |
| Ethylenediaminetetraacetic acid | 100 to 500 ppm |
| 8000 Mw Polyethylene glycol | 100 to 500 ppm |
| Chrometan powder (75% w/w chromium sulfate) | 140 to 180 g/l |
| Ammonium sulfate | 50 to 200 g/l |
| Boric acid | 15 to 30 g/l |
| Sodium n-dodecyl sulfate | 0.2 to 0.6 g/l |

-continued

| Compound | Approximate Range (when present) |
|---|---|
| Chromium (II) chloride | 0.15 to 0.5 g/l |
| Potassium hydroxide | 20 to 32 g/l. |

3. The method of claim 2 wherein an interval of no electric current flow is interposed between the cathodic pulses.

4. The method of claim 2 wherein the cathodic pulses form a pulse train having a frequency between about 100 Hertz and about 6000 Hertz.

5. The method of claim 2 wherein the cathodic pulses form a pulse train having a frequency between about 200 Hertz and about 2000 Hertz.

6. The method of claim 2 wherein the cathodic pulses form a pulse train having a frequency between about 500 Hertz and about 1000 Hertz.

7. The method of claim 2 wherein the cathodic pulses form a pulse train having a frequency of about 100 Hertz or greater.

8. The method of claim 2 wherein the cathodic pulses form a pulse train having a frequency of about 500 Hertz or greater.

9. The method of claim 2 wherein the cathodic pulses have a duty cycle of at least about 80%.

10. The method of claim 9 wherein the duty cycle is about 85 to 95%.

11. The method of claim 2 wherein the electroplating bath may additionally include a metal selected from the group consisting of copper, silver, gold, zinc, nickel, bronze, brass, and alloys thereof.

12. The method of claim 2 wherein a layer of metal of substantially uniform thickness is deposited on the surface.

13. The method of claim 2 wherein the bath has a pH of about 2.5.

14. The method of claim 2 wherein the electric current has a current density between about 25 and about 45 $A/dm^2$.

* * * * *